US007207562B1

(12) United States Patent
Gallagher et al.

(10) Patent No.: US 7,207,562 B1
(45) Date of Patent: Apr. 24, 2007

(54) SUITS AND LADDERS GAME

(76) Inventors: L. Scott Gallagher, 133 Ousamequin Pines Rd., E. Bridgewater, MA (US) 02333; Christina L. Gallagher, 133 Ousamequin Pines Rd., E. Bridgewater, MA (US) 02333

( * ) Notice: Subject to any disclaimer, the term of this patent is extended or adjusted under 35 U.S.C. 154(b) by 220 days.

(21) Appl. No.: 11/053,563

(22) Filed: Feb. 9, 2005

(51) Int. Cl.
*A63F 1/00* (2006.01)

(52) U.S. Cl. ..... 273/247

(58) Field of Classification Search ..... 273/274, 273/292, 309; 463/12, 13
See application file for complete search history.

(56) References Cited

U.S. PATENT DOCUMENTS

| | | | | |
|---|---|---|---|---|
| 830,424 | A | 9/1906 | Ferris | |
| 1,463,871 | A | 8/1923 | Chisolm | |
| 2,062,168 | A | 11/1936 | Entwistle | |
| 4,861,041 | A | 8/1989 | Jones et al. | |
| 5,593,161 | A * | 1/1997 | Boylan et al. | 273/274 |
| 5,713,573 | A | 2/1998 | Nazaryan | |
| 5,718,431 | A * | 2/1998 | Ornstein | 273/292 |
| 5,882,009 | A | 3/1999 | Schaefer | |
| 5,918,884 | A | 7/1999 | DiMuro | |
| 6,065,752 | A | 5/2000 | Beltran | |
| 6,079,713 | A | 6/2000 | Paz | |
| 6,189,888 | B1 * | 2/2001 | Brunelle | 273/292 |
| 6,336,859 | B2 | 1/2002 | Jones et al. | |
| RE37,588 | E | 3/2002 | Ornstein | |
| 6,439,573 | B1 * | 8/2002 | Sklar | 273/292 |
| 6,550,772 | B1 * | 4/2003 | Streeks et al. | 273/292 |
| 6,575,467 | B1 * | 6/2003 | Kal | 273/292 |
| 6,585,588 | B2 * | 7/2003 | Hartl | 463/16 |
| 6,648,754 | B2 * | 11/2003 | Baerlocher et al. | 463/17 |
| 6,679,492 | B2 * | 1/2004 | Markowiak | 273/138.1 |
| 6,789,800 | B2 | 9/2004 | Webb | |
| 7,048,274 | B2 * | 5/2006 | Duncombe et al. | 273/274 |
| 7,137,629 | B2 * | 11/2006 | Chapman | 273/292 |
| 2004/0066001 | A1 | 4/2004 | Duncombe et al. | |
| 2004/0178580 | A1 | 9/2004 | Schwartz | |
| 2004/0178581 | A1 | 9/2004 | Abuan | |

* cited by examiner

*Primary Examiner*—William M. Pierce
(74) *Attorney, Agent, or Firm*—John P. McGonagle

(57) ABSTRACT

A wagering game between a dealer and one or more players involving one or more decks of cards, a betting board and player markers. The betting board has four columns of betting places, each column corresponding to one of four card suits, said betting places being arranged in rows of four, one betting place for each column. Each row is set at a progressively increasing designated odds payoff. Each player makes a bet by selecting a betting place with a marker. A dealer deals one card to each player. If the column of the betting place matches the suit of the card dealt, the player is a winner. The winner may accept the designated odds payoff or may advance up the column to a higher designated odds payoff row. If the player's betting place column does not match the suit of the card dealt, the dealer is the winner. Players may make side bets on the value of the card dealt as agreed to between player and dealer.

5 Claims, 2 Drawing Sheets

SUITS AND LADDERS GAME

BACKGROUND OF THE INVENTION

This invention relates to wagering games involving a dealer, one or more players, and one or more decks of cards having a plurality of suits.

Many card games have been developed and some are particularly adapted for gambling. One class of such games includes a dealer who deals cards and a plurality of players who place wagers based on the cards that the dealer deals. Various progressive jackpot wagering games have also been developed. Other games also disclose the concept of adding additional wagers when cards are dealt.

There is a demand for new card games, particularly by casinos, which are, at the same time, innovative and interesting, but simple enough for players to easily learn. It has been found that many potential players are discouraged from playing because they do not understand the complexity of the game and are self-conscious about showing their lack of expertise.

Accordingly, it is an object of the present invention to provide an improved wagering game, which is innovative and interesting.

It is also an object of the invention to provide an improved wagering game for casinos which is simple enough for most persons to understand without complicated instructions.

SUMMARY OF THE INVENTION

In accordance with these objects, there is provided, according to one aspect of the invention, a wagering game between a dealer and one or more players involving one or more decks of cards, a betting board and player markers. The betting board has four columns of betting places, each column corresponding to one of four card suits, said betting places being arranged in rows of four, one betting place for each column. Each row is set at a progressively increasing designated odds payoff. Each player makes a bet by selecting a betting place with a marker. A dealer deals one card to each player. If the column of the betting place matches the suit of the card dealt, the player is a winner. The winner may accept the designated odds payoff and may advance the original bet amount up the column to a higher designated odds payoff row. If the player's betting place column does not match the suit of the card dealt, the dealer is the winner. Players may make side bets on the value of the card dealt as agreed to between player and dealer.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
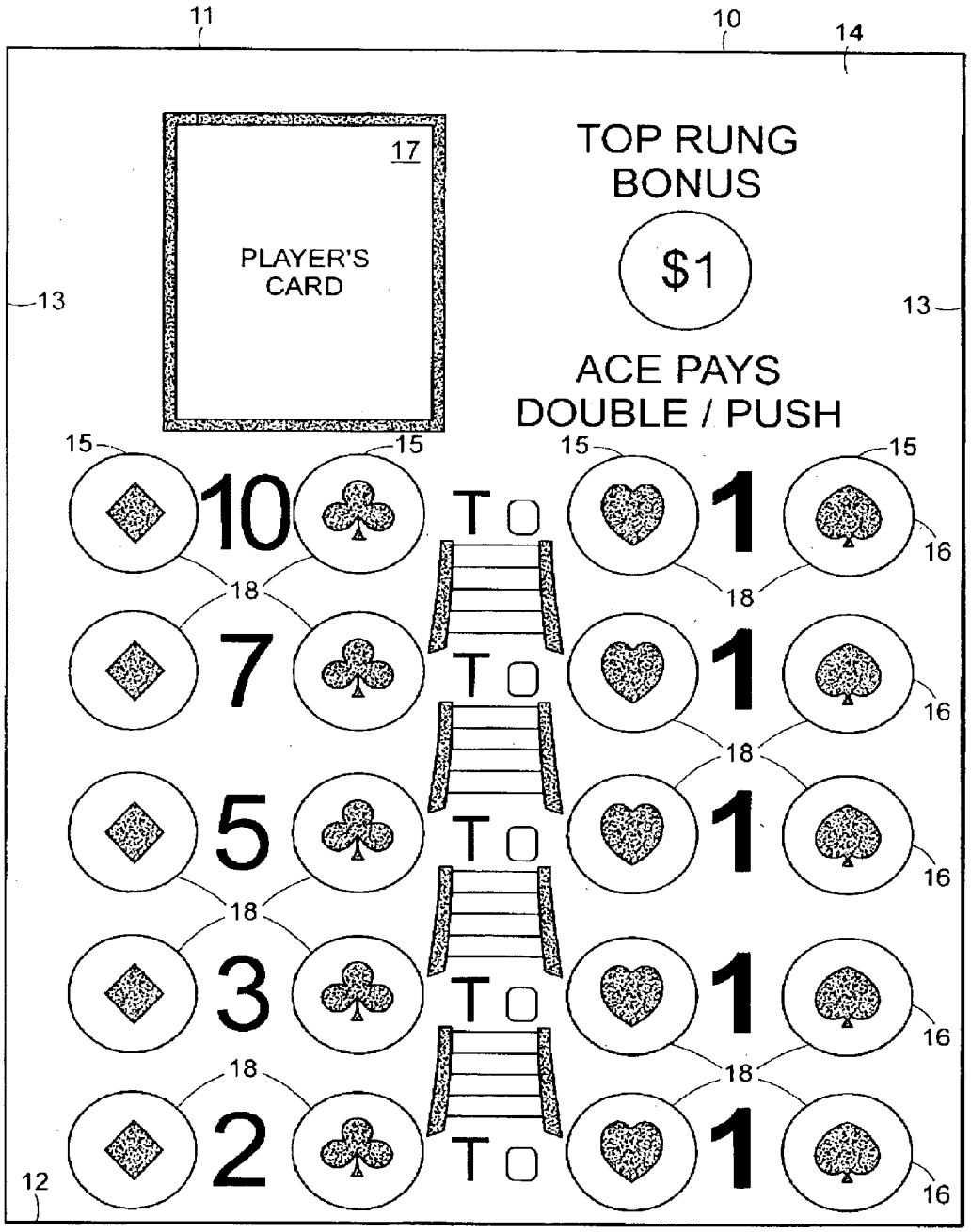
FIG. 1 is a top plan view of a board used in the invention.

Referring to the drawings in detail wherein like elements are indicated by like numerals, there is shown in FIG. 1 a generally rectangular, flat, player's board 10 having a top 11, bottom 12, two opposite side edges 13 and a playing surface 14. The playing surface 14 has a plurality of betting spaces 18 arranged into four vertical columns 15 corresponding to the four suits of a standard deck of playing cards. The betting spaces 18 are also arranged into a five rows 16, one betting space 18 for each column 15. Other embodiments may have more or less rows. Each row 16 is set at a progressively increasing designated odds payoff, with the row 16 closest to the player board bottom being set at the lowest odds. The odds progress as the rows move closest to the player board top 11, with the row 16 closest to the player board top 11 having the greatest odds. In this embodiment of the invention, the row odds progress as follows: 1:1, 4:1, 5:1, 6:1, and 10:1. Adjacent the player board top 11 is an area 17 for the player's card.

Figure 2:
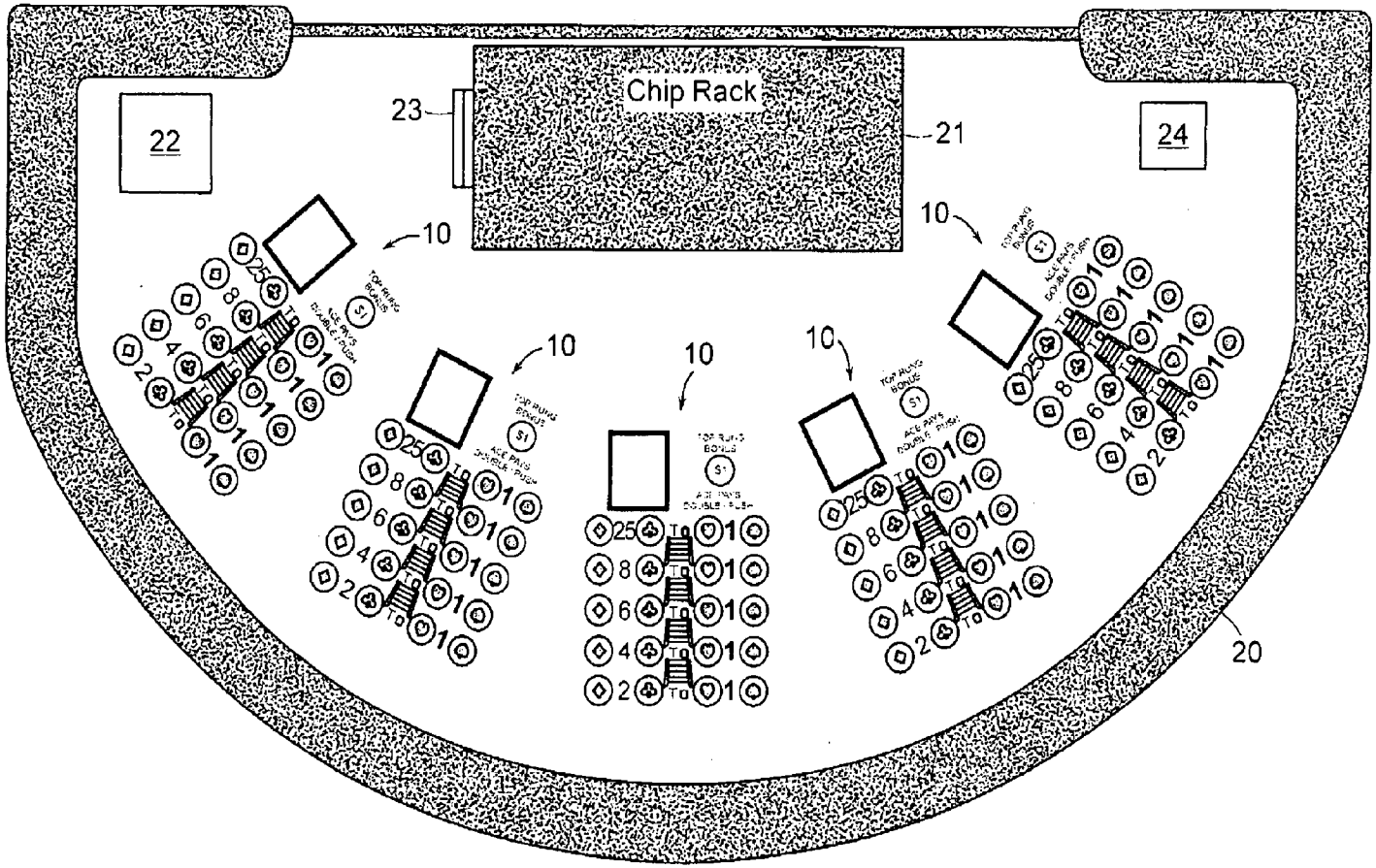
FIG. 2 is a top plan view of a board table layout for multiple players.

FIG. 2 illustrates a typical board table layout 20 for the game, including a chip rack area 21, discard area 22, cash slot 23 and card shoe area 24. There is also five player betting areas 25 with a player board 10 imprinted in each area.

The game of the present invention revolves around bets on specific card suits. A player places a wager on any one or two of the four betting spaces 18 on the bottom row 16. The dealer then flips a single card for play. If the player has successfully selected (matched) the suit on the dealt card, the dealer then pays the appropriate odds designated for that row. The player, at his option, can now move his original winning wager up to any one of the four betting spaces on the next row, at the increased payout odds for that row. This is considered "climbing the ladder." When climbing the ladder, if the player has successfully selected (matched) the suit on the bottom row, the player can then bet the amount of his original wager from the bottom row up onto the next row. Game play continues until the player reaches the top row matching suits in each row up to the top row, or fails to match a suit on any row. If a player unsuccessfully selects the dealt suit, the dealer then collects the wager and the player must begin again at the bottom row.

In another embodiment of the game, an optional side bet may be made. If a player chooses, he can make an additional side bet as follows. If an ace is flipped by the dealer and the player has correctly selected the proper suit, the dealer then pays the player double the payoff odds for the particular row the player has bet in. If an ace is flipped and the player has incorrectly selected the proper suit, the wager is a "Push" and the player is allowed to receive a second dealt card (2nd chance) to try and match the selected suit.

In another embodiment of the invention, a top rung bonus is designated. If the player reaches the top row matching all betting space suits successfully, including the top row, the dealer then pays the player a designated Top Rung Bonus, being a set amount or Progressive Jackpot, to be determined by the house or casino.

It is understood that the above-described embodiment is merely illustrative of the application. The house or casino may have the option for a single deck deal or multiple deck deal. Other embodiments may be readily devised by those skilled in the art which will embody the principles of the invention and fall within the spirit and scope thereof.

We claim:

1. A method of playing a wagering card came between a dealer and a plurality of players using a plurality of fifty-two card decks having four suits, comprising the sequential steps of:

providing each player with a generally rectangular, flat, player's board having a top, bottom, two opposite side edges and a playing surface, said playing surface having a plurality of betting spaces arranged into four vertical columns corresponding to the four suits of a standard deck of playing cards, said betting spaces being arranged into a plurality of rows, one betting space for each column, each row being set at a progressively increasing designated odds payoff, with the row closest to the player board bottom being set at the lowest odds, said odds progressing row-by-row as the rows move closest to the player board top, with the row closest to the player board top having the greatest odds;

each player placing a wager on any one or two of the four betting spaces on the bottom row;

the dealer flipping a single card for play for each player;

the dealer paying the appropriate odds designated for that row where a player has successfully selected the suit of the flipped card;

each player having successfully selected the suit on the flipped card, at his option, moving his original winning wager up to any one of the four betting spaces on the next row, at the increased payout odds for that row;

repeating the above steps until a player reaches the top row matching suits in each row up to the top row, or fails to match a suit on any row;

the dealer collecting each wager of a player who unsuccessfully selects a dealt suit;

the player who unsuccessfully selects a dealt suit, beginning again at the bottom row.

2. A method of playing a wagering game as recited in claim 1, further comprising:

a player placing a side bet that a playing card ace will be flipped by the dealer;

the dealer paying the player double the payoff odds if an ace is flipped by the dealer and the player has correctly selected the proper suit.

3. A method of playing a wagering game as recited in claim 2, further comprising:

the dealer dealing a second card to a player if an ace is flipped and the player has incorrectly selected the proper suit, wherein the wager is a push and the player is allowed a second chance to match the suit of the second card.

4. A method of playing a wagering game as recited in claim 3, further comprising:

the dealer paying a player a top rung bonus to a player reaching the top row matching all betting space suits successfully, including the top row.

5. A method of playing a wagering game as recited in claim 4, wherein:

each playing card has five rows, said rows having payout odds progressing as follows: 1:1, 4:1, 5:1, 6:1, and 10:1.

* * * * *